US008806843B2

(12) United States Patent
Chang

(10) Patent No.: US 8,806,843 B2
(45) Date of Patent: Aug. 19, 2014

(54) SELF-STANDING BAG WITH FOLDABLE FLANGE

(75) Inventor: Lu-Wen Chang, Taichung (TW)

(73) Assignee: S-Pouch Pak Co., Ltd., Taichung (TW)

( * ) Notice: Subject to any disclaimer, the term of this patent is extended or adjusted under 35 U.S.C. 154(b) by 134 days.

(21) Appl. No.: 13/546,257

(22) Filed: Jul. 11, 2012

(65) Prior Publication Data

US 2012/0275727 A1 Nov. 1, 2012

Related U.S. Application Data

(63) Continuation-in-part of application No. 12/546,627, filed on Aug. 24, 2009, now abandoned.

(30) Foreign Application Priority Data

Aug. 26, 2008 (CN) ..... 2008 2 0133801 U

(51) Int. Cl.
*B65B 1/04* (2006.01)

(52) U.S. Cl.
USPC ..... 53/467; 53/471; 53/484; 53/133.2

(58) Field of Classification Search
USPC ..... 53/467, 468, 471, 473, 484, 79, 97, 53/133.2; 493/186, 213, 87
See application file for complete search history.

(56) References Cited

U.S. PATENT DOCUMENTS 4,512,136 A * 4/1985 Christine ..... 53/410
4,553,971 A 11/1985 Ashley et al.
4,691,368 A 9/1987 Roessiger
4,710,157 A * 12/1987 Posey ..... 493/213
5,033,867 A 7/1991 Peppiatt
5,254,074 A * 10/1993 Landers et al. ..... 493/213
5,788,121 A * 8/1998 Sasaki et al. ..... 222/105
5,862,653 A * 1/1999 Solano ..... 53/562
5,873,969 A * 2/1999 Keith et al. ..... 156/91
5,937,614 A * 8/1999 Watkins et al. ..... 53/79
6,046,443 A * 4/2000 Ackerman et al. ..... 219/727
6,272,815 B1 * 8/2001 Todd et al. ..... 53/562
6,581,357 B1 * 6/2003 Lindenberger ..... 53/412
6,783,277 B2 8/2004 Edwards et al.
6,986,237 B2 * 1/2006 Ausnit et al. ..... 53/412
7,011,615 B2 * 3/2006 Price et al. ..... 493/210
7,021,036 B2 * 4/2006 Hiramoto et al. ..... 53/562
7,419,300 B2 9/2008 Pawloski et al.
7,497,066 B2 * 3/2009 Calogero ..... 53/403
7,571,584 B2 * 8/2009 Lerner et al. ..... 53/79
7,600,360 B2 * 10/2009 Schroeder et al. ..... 53/452
8,056,598 B2 * 11/2011 Chiang ..... 156/497

FOREIGN PATENT DOCUMENTS

JP 2001233357 A 8/2001
WO 9008704 A2 8/1990

* cited by examiner

*Primary Examiner* — Sameh H. Tawfik
(74) *Attorney, Agent, or Firm* — Egbert Law Office, PLLC

(57) ABSTRACT

A self-standing bag with foldable flanges includes a main body, available with two corresponding side walls and a top connected at the top of two side walls. A nozzle is set centrally or laterally onto the top wall, and covered by a cover in openable state. The foldable flanges are arranged at the top of two side walls of the main bag body, and openings are formed between two corresponding sides of the foldable flanges. The self-standing bag can be positioned more reliably for an improved advertising effect.

3 Claims, 14 Drawing Sheets

SELF-STANDING BAG WITH FOLDABLE FLANGE

CROSS-REFERENCE TO RELATED U.S. APPLICATIONS

The present application is a continuation-in-part of U.S. patent application Ser. No. 12/546,627, filed on Aug. 24, 2009, and entitled "Self-Standing Bag with Foldable Flange."

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a self-standing bag, and more particularly to an innovative one which allows foldable flanges to be assembled at top of two side walls of the main body.

2. Description of Related Art Including Information Disclosed Under 37 CFR 1.97 and 37 CFR 1.98

Self-standing bags are widely used to as refill packages for liquid products (e.g. laundry detergent, softener), powder (e.g. detergent, feed), or granule products.

A conventional self-standing bag is depicted in FIG. 1, wherein the bottom 03 of the self-standing bag 02 can be expanded physically into a bigger area, and the top 04 can be compressed in a flat pattern. However, the following shortcomings are observed during actual applications:

First, regarding the stability of arrangement: the side wall 05 is tilted when the conventional self-standing bag 02 is expanded by some objects, so the bottom wall of the self-standing bag 02 will be stretched into an arced shape. In such a case, only two opposite corners of the bottom 03 of the self-standing bag 02 are stably supported, leading to instability of the conventional self-standing bag. Thus, it is not an ideal design for sales in shops and arrangement by the users.

Second, regarding the ads effect: the space available for advertisement is only limited to the side wall 05 of the self-standing bag 02, without mentioning the overlapped portion around the side wall 05, so the commercial effect of the self-standing bag is not suitable for marketing purposes.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the unique design of the present invention wherein the self-standing bag allows foldable flanges to be assembled at top of two side walls, and the top of these two side walls is separated by the top wall, so that when the self-standing bag is filled with some objects, the two side walls can be expanded into a tubular space, and then the bottom of these two side walls is supported in a flush state, enabling the self-standing bag to be positioned stably for the purpose of smooth sales and reliable arrangement.

Based on the unique design of the present invention wherein foldable flanges are assembled at the top of two side walls, the print ads space of the self-standing bag can be further increased, thus providing a clearer and wider picture for improved graphical representation and marketing purpose.

Based on the manufacturing design of the present invention wherein a side of the upper side wall forming belt is bent into a folding flange, and the top wall forming belt is abutted against the folding flange in a flush state, the nozzle could be more easily and flexibly incorporated onto the top wall forming belt, either centrally or laterally.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
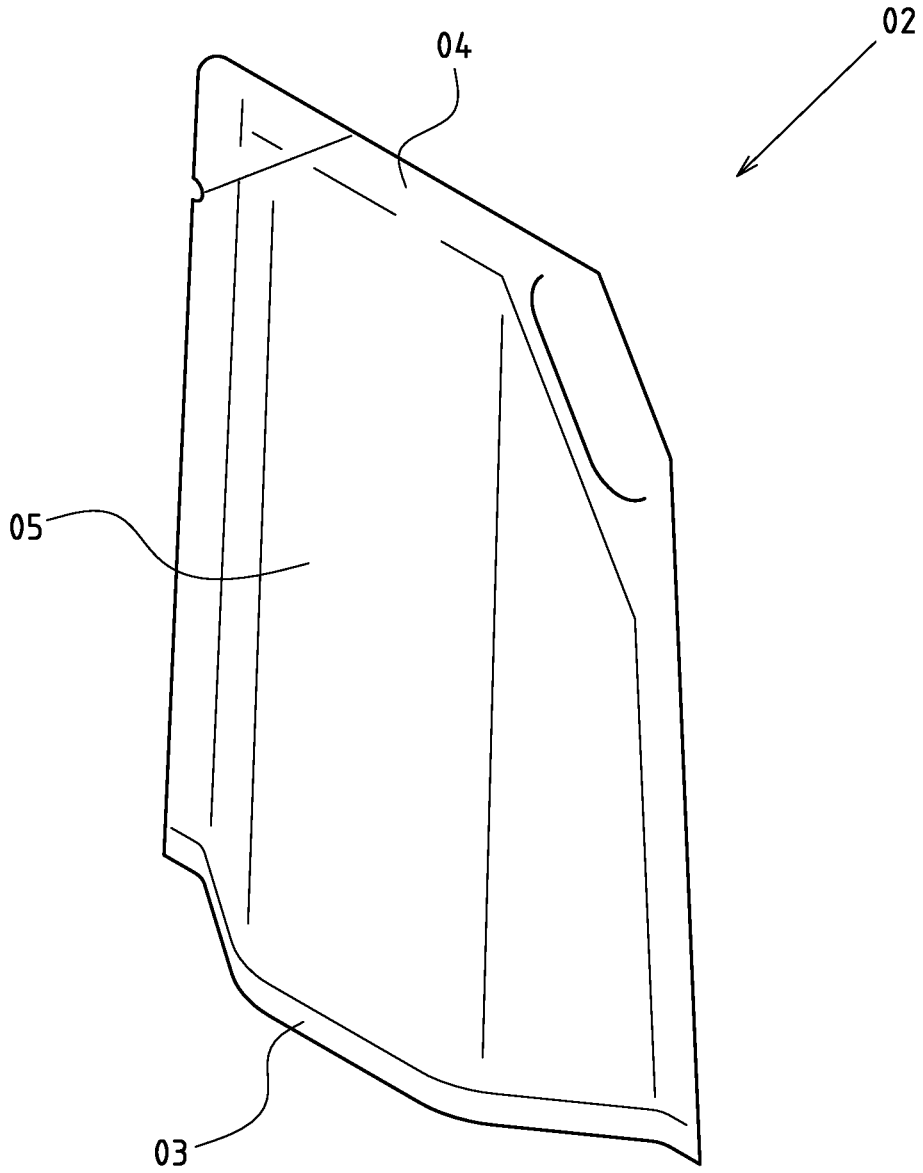
FIG.1 PRIOR ART
FIG. 1 shows a perspective view of a typical structure.
Figure 2:
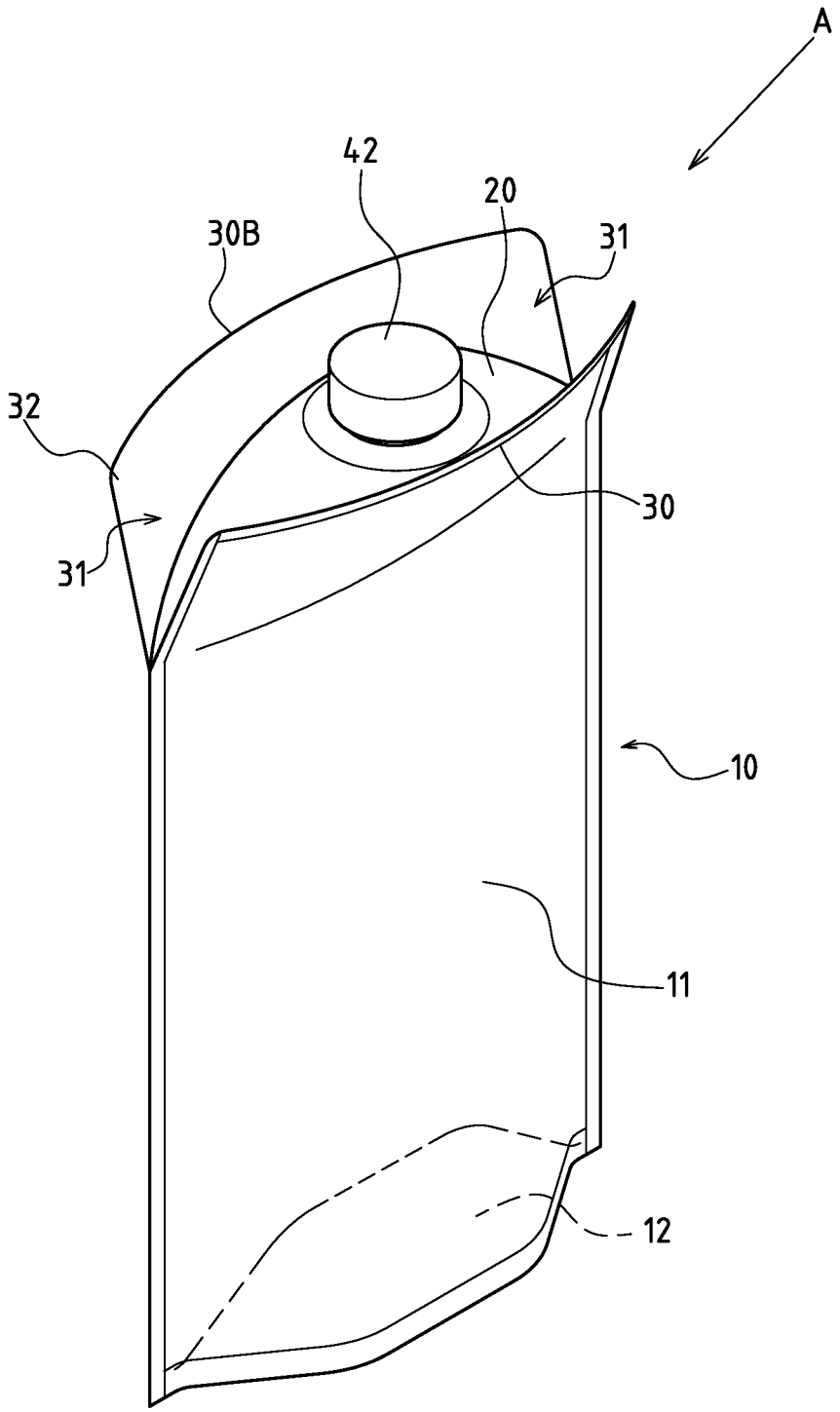
FIG. 2 shows a perspective view of a preferred embodiment of the present invention.
Figure 3:
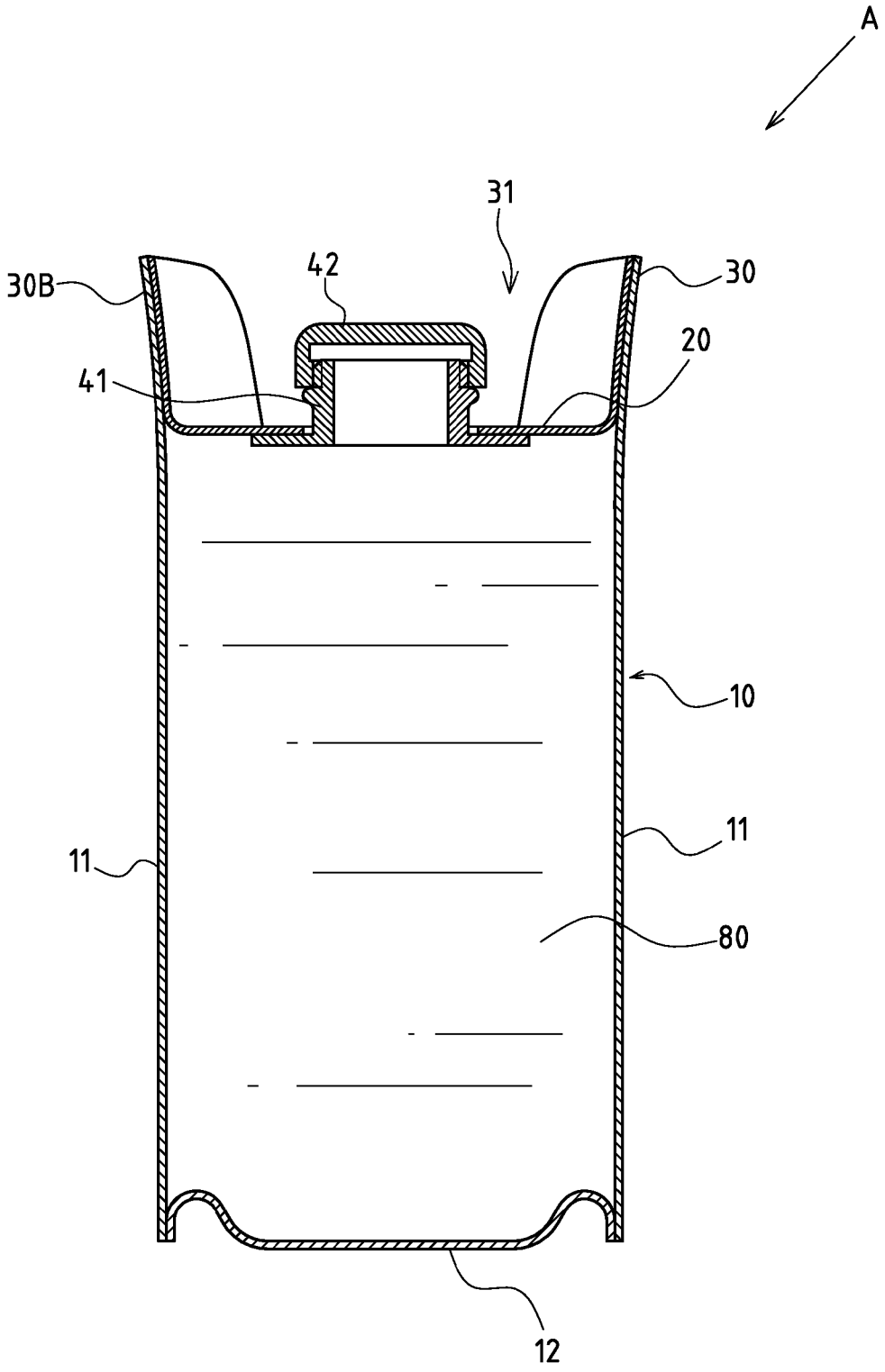
FIG. 3 shows a plane sectional view of a preferred embodiment of the present invention.
Figure 4:
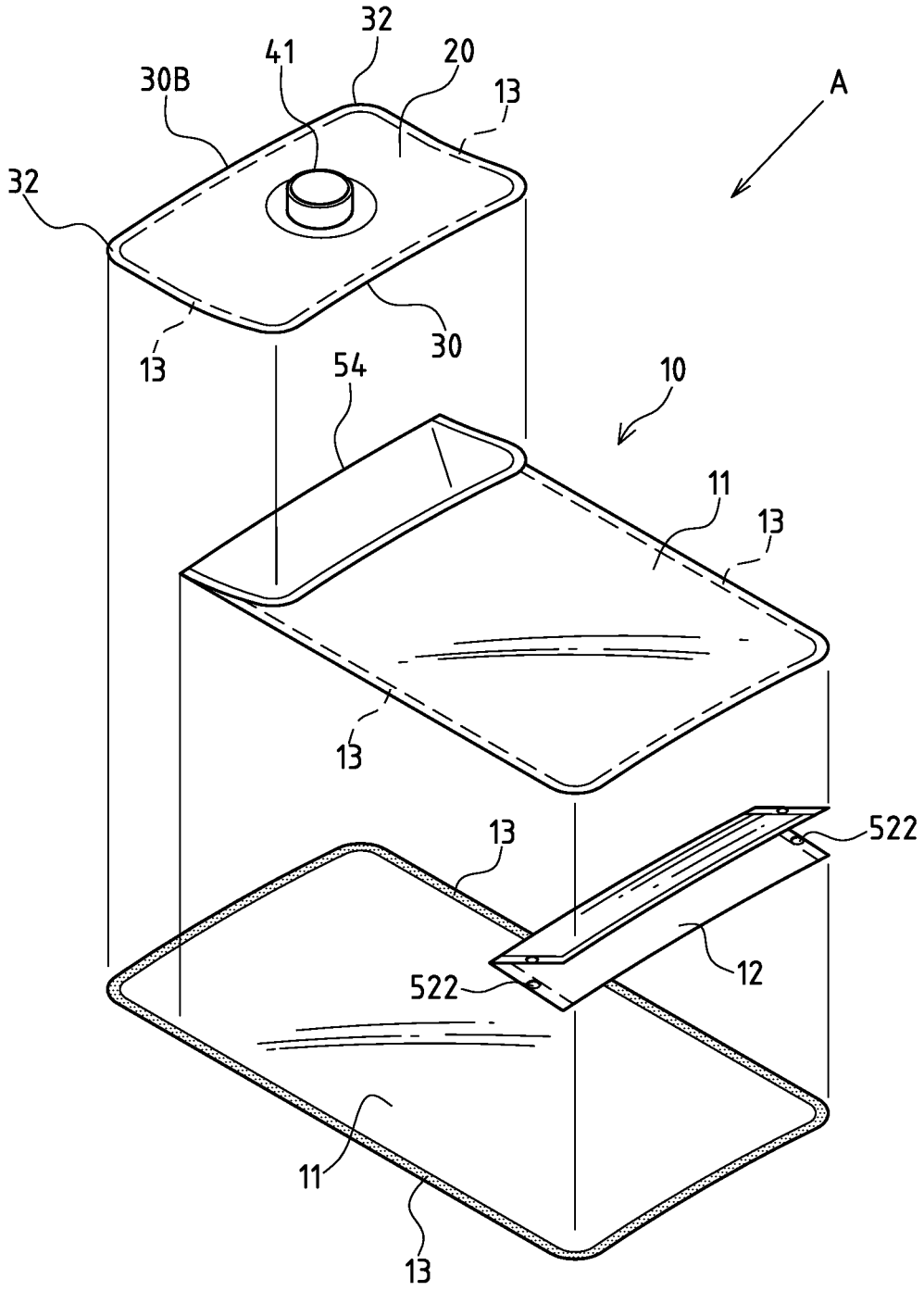
FIG. 4 shows an exploded perspective view of the structure of the present invention.

FIGS. 2-4 depict preferred embodiments of a self-standing bag of the present invention with foldable flange, which, however, are provided for only explanatory objective for patent claims.

The self-standing bag A comprises a main bag body 10 including two side walls 11, and a top wall 20, which is connected between the top of two side walls 11 of the main bag body 10 (see FIG. 3).

Two foldable flanges 30, 30B, are extended from the top of two side walls 11 of the main bag body 10 to a proper area. Moreover, two openings 31 are formed between two corresponding sides of the foldable flanges 30, 30B.

A nozzle 41, which is of solid tubular shape, is protruded centrally or laterally onto the top wall A cover 42 is used to cover onto the nozzle 41 in an openable state.

Of which, a bottom wall 12 is formed between the bottom end of two side walls 11. The bottom wall 12 is set into a folding pattern hot-pressed between two side walls 11.

Figure 5:
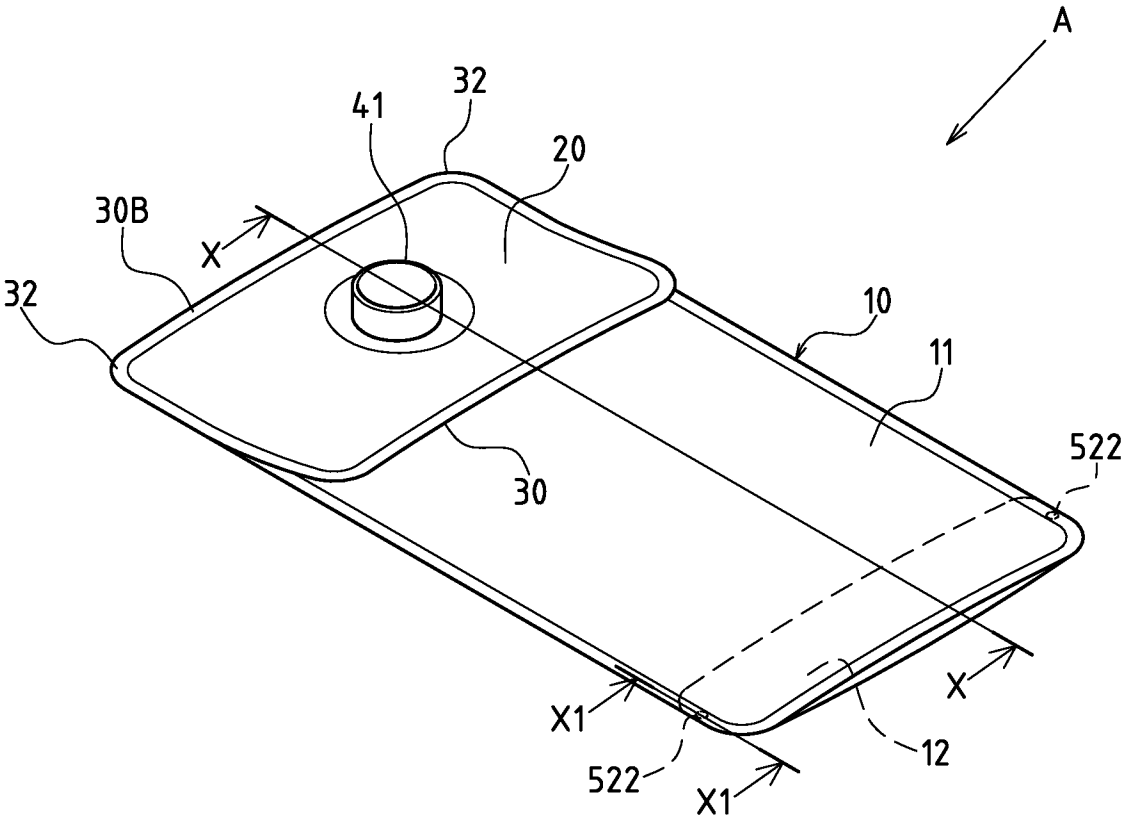
FIG. 5 shows a flat perspective view of the present invention.
Figure 6:
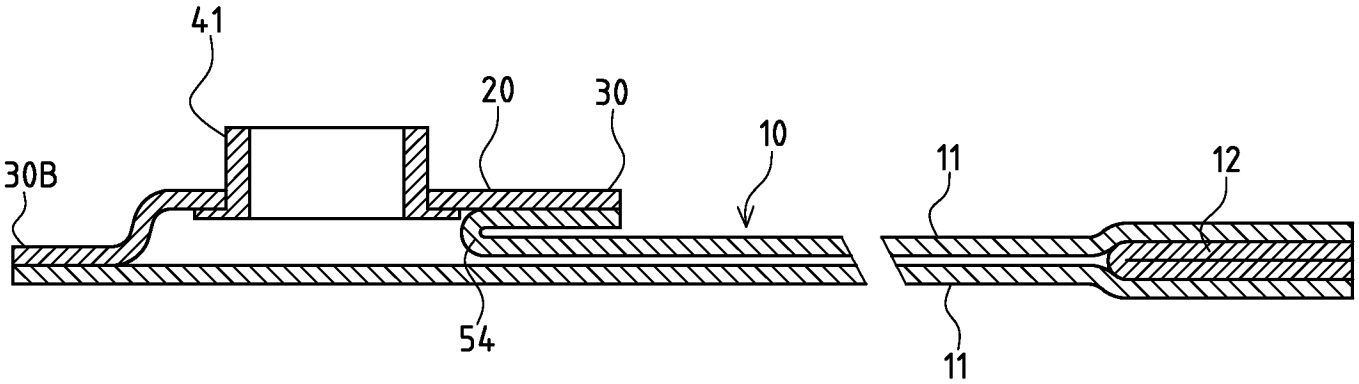
FIG. 6 shows a sectional view of the present invention along X-X of FIG. 5.
Figure 7:
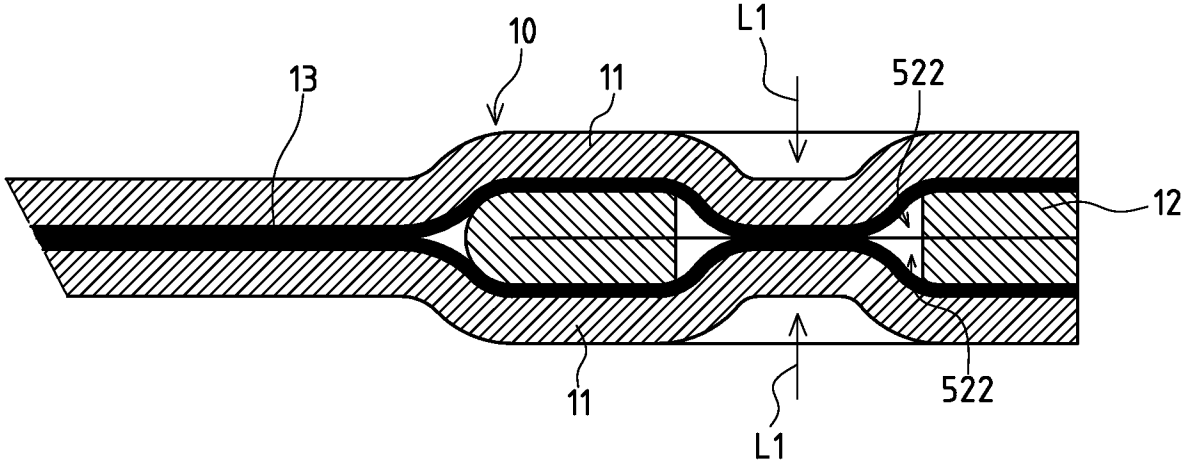
FIG. 7 shows a sectional view of the present invention along X1-X1 of FIG. 5.

Of which, when the self-standing bag A is in a compressed state, two foldable flanges 30, 30B are set into an expanded plain pattern (see FIG. 5). One foldable flange 30 is flushed with one side wall 11 of the main bag body 10, so that the main bag body 10, top wall 20, bottom wall and two foldable flanges 30, 30B are set into a flat pattern;

Moreover, when the self-standing bag A is in a compressed state, two side walls 11 are mated with two laminating edges 13 by hot-pressing (see FIGS. 4, 7). Of which, one folding flange is formed on a side wall 11 and mated with a half of the top wall 20. The other half of the top wall 20 is mated with the other side wall 11 by hot-pressing. The bottom wall 12 is set into a folding pattern hot-pressed between two side walls 11.

Referring also to FIGS. 4 and 7, through-holes 522 are formed at both sides of the bottom wall 12 in a folding pattern. Said through-holes 522 are aligned with hot-pressing position, so that the corresponding two side walls 11 can penetrate said through-holes 522 in hot-pressing fusion state (marked by L1 in FIG. 7). The periphery of said two side walls 11 is of a flat pattern. When the self-standing bag A is filled with object 80 (in collaboration with FIG. 3), two side walls 11 of the self-standing bag A can be supported into a straight tubular pattern. Moreover, the profile of said side wall 11 and bottom wall 12 is of lobed shape, so that the bottom of these two side walls 11 is supported in a flush state, and the bottom wall 12 is supported in a flared state, enabling the self-standing bag A to be positioned stably.

Of which, the corners 32 of the foldable flanges 30, 30B are designed into rectangular or obtuse (e.g. beveling and rounding) patterns. FIG. 2 depicts the rounding pattern of the corners 32. Besides, the cover 42 and nozzle 41 are set into either of screwed, snapped or flipped patterns. Also, a screwed pattern is referenced in the present invention.

Figure 8:
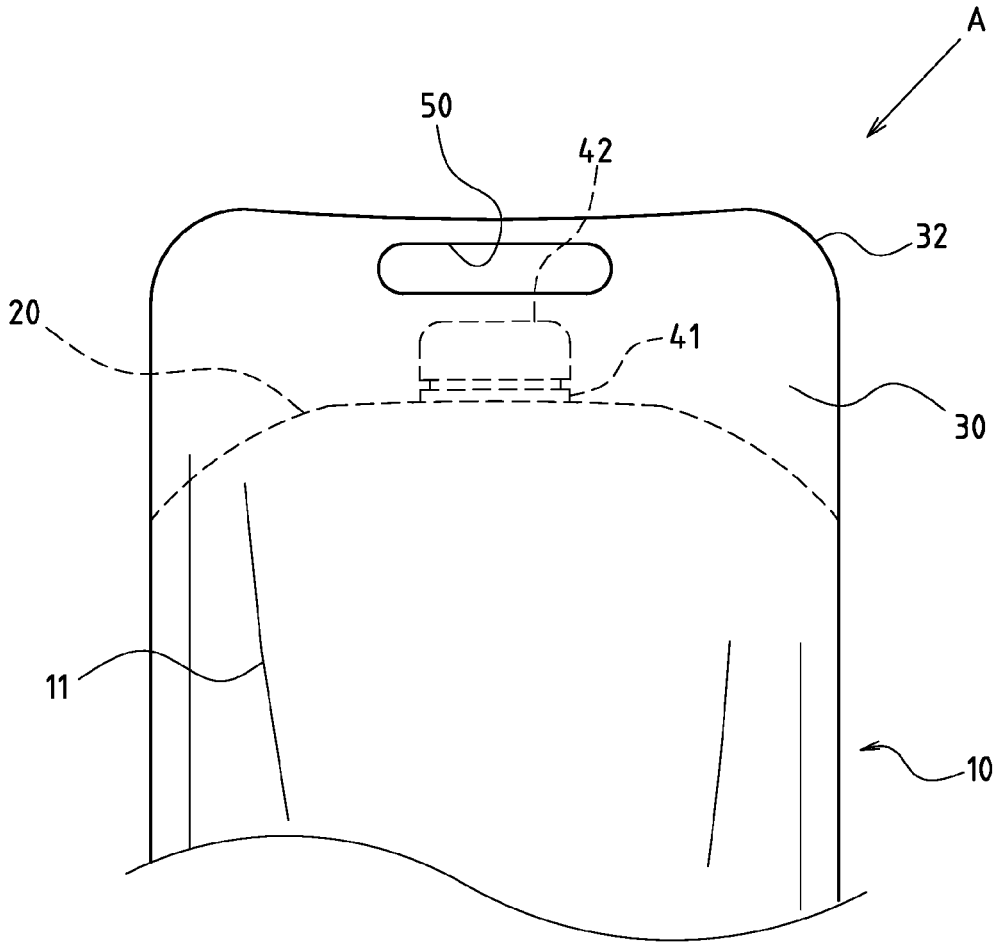
FIG. 8 shows a schematic view of the present invention wherein the foldable flanges are additionally provided with a handle hole.

Referring to FIG. 8, the foldable flanges 30, 30B can be additionally provided with a handle hole 50, allowing the user to lift and carry manually the self-standing bag.

Figure 9:
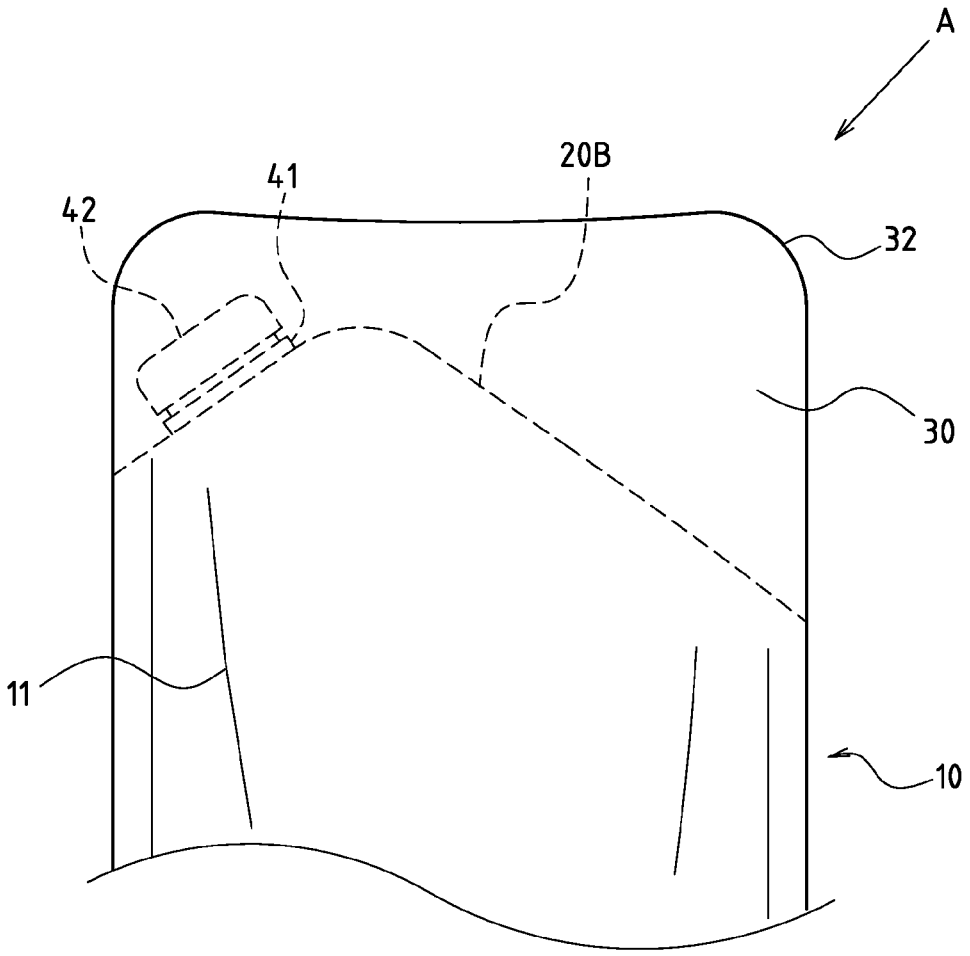
FIG. 9 shows another schematic view of the top wall of the present invention.

Referring to FIG. 9, the nozzle 41 and cover 42 of the preferred embodiment are placed laterally onto the top wall 20B, and the top wall 20B is set into a downward inclined plane.

Figure 10:
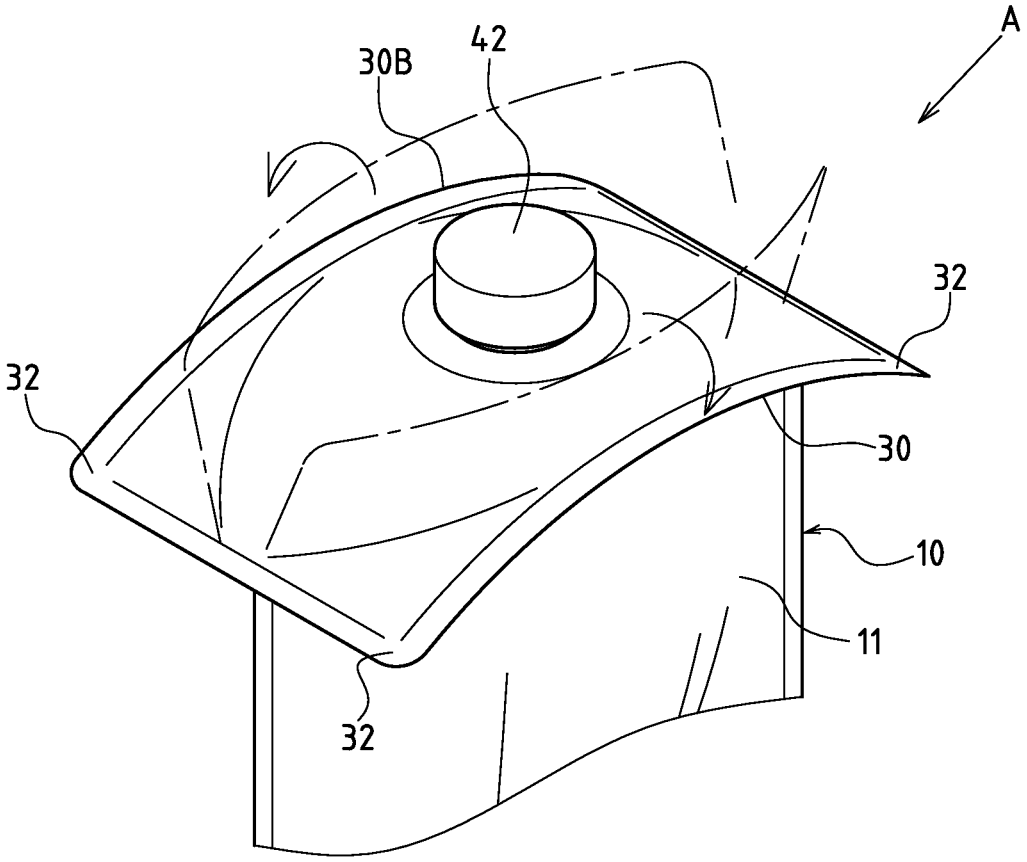
FIG. 10 show a schematic view of the present invention wherein the foldable flanges are folded into a transversely extension state.
Figure 11:
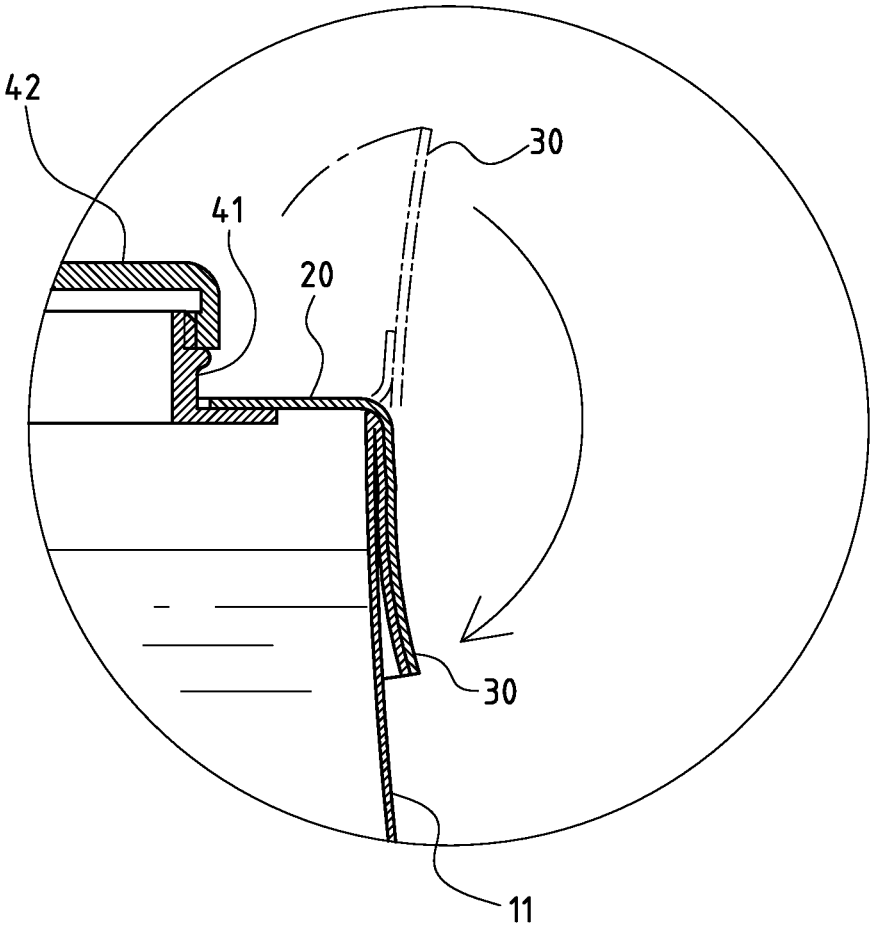
FIG. 11 shows a schematic view of the present invention wherein the foldable flanges are folded downwards.

Referring to FIGS. 10 and 11, the foldable flanges 30, 30B are extended from the top of two side walls 11 of the main bag body 10. In practice, these two foldable flanges 30, 30B can be folded into a transversely extension state, or folded downwards to be abutted externally against the side wall 11.

Figure 12:
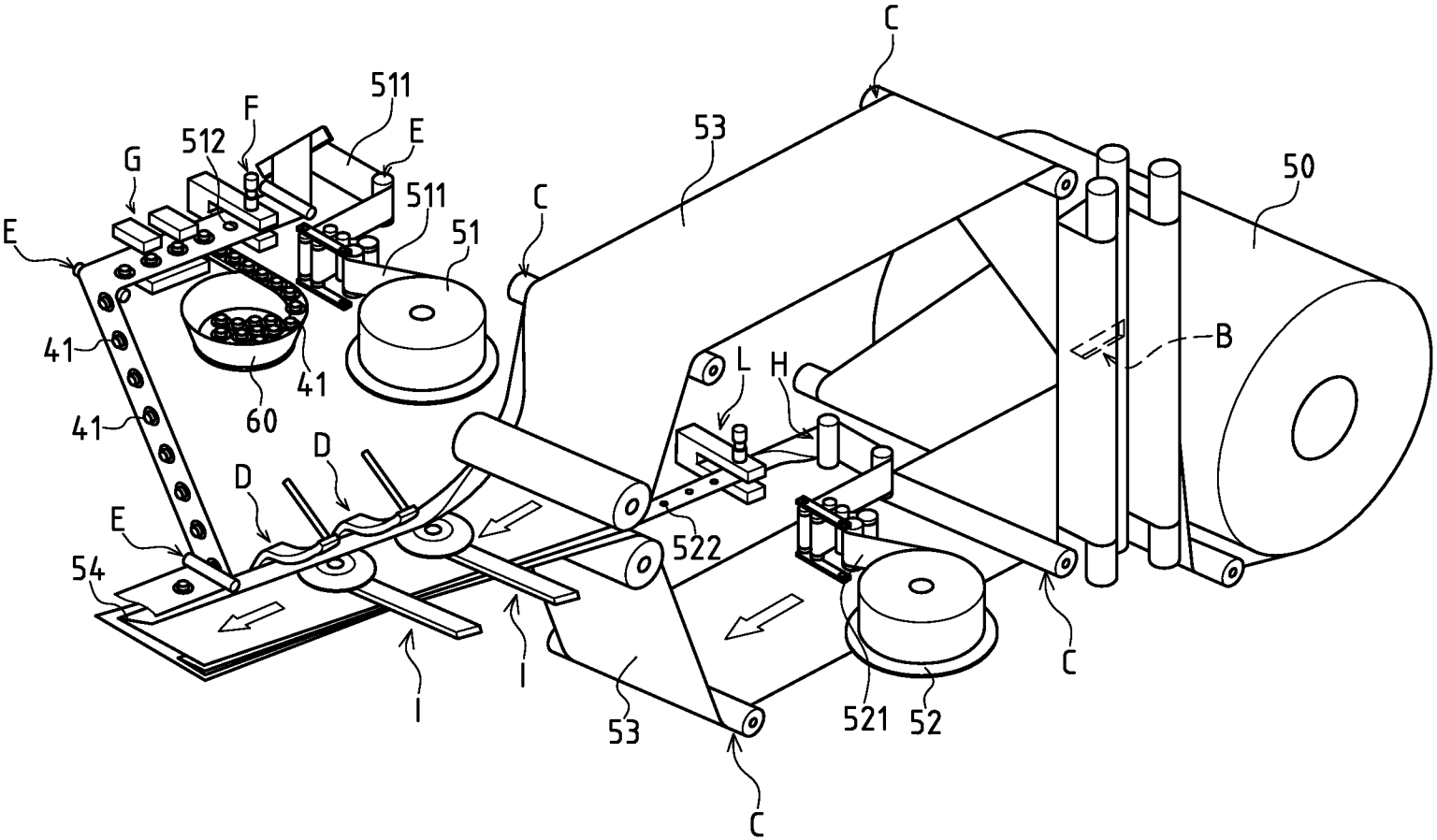
FIG. 12 shows a schematic view of the fabrication methods of the present invention.
Figure 13:
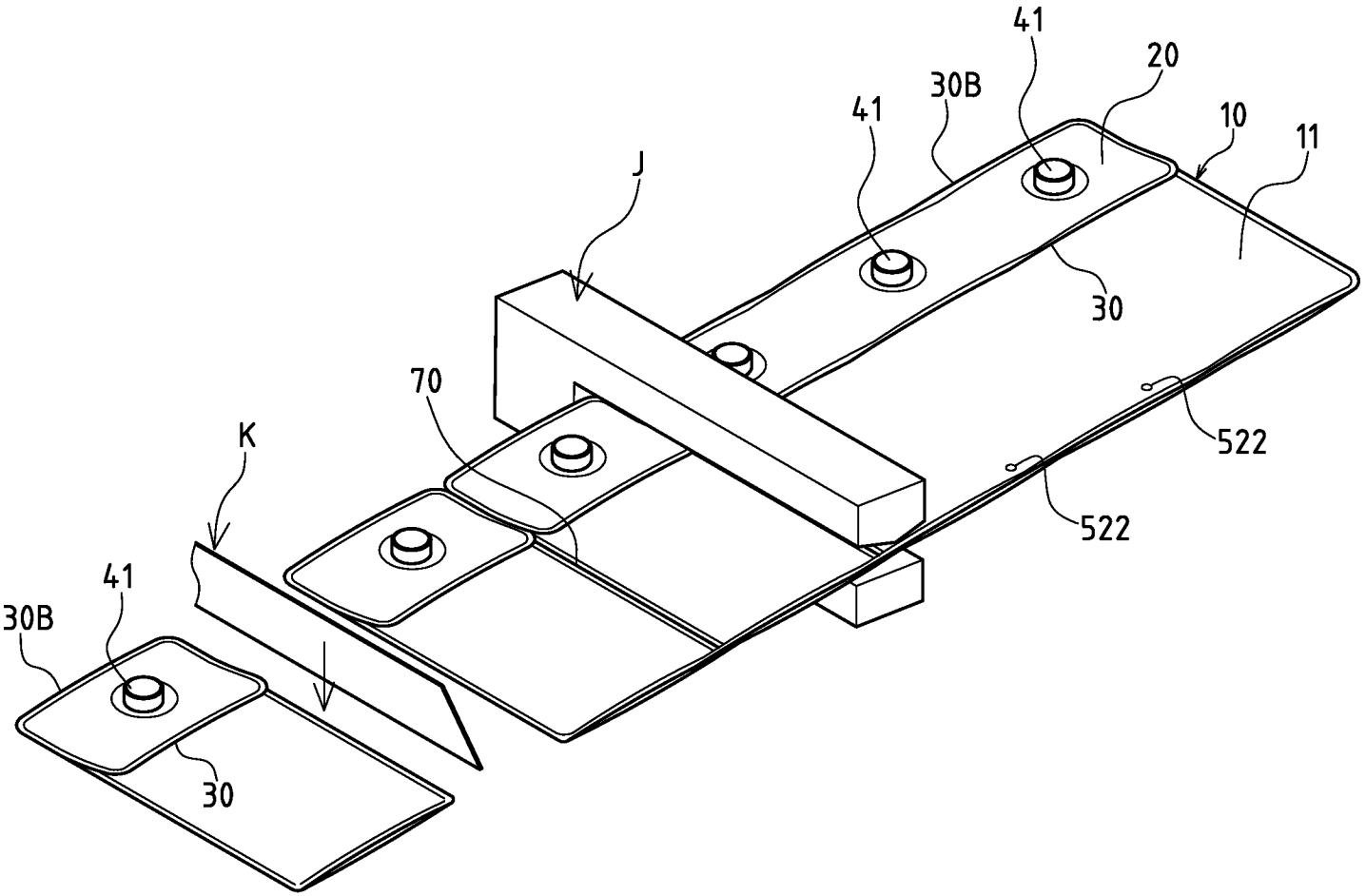
FIG. 13 shows a schematic view of the fabrication methods of the present invention.
Figure 14:
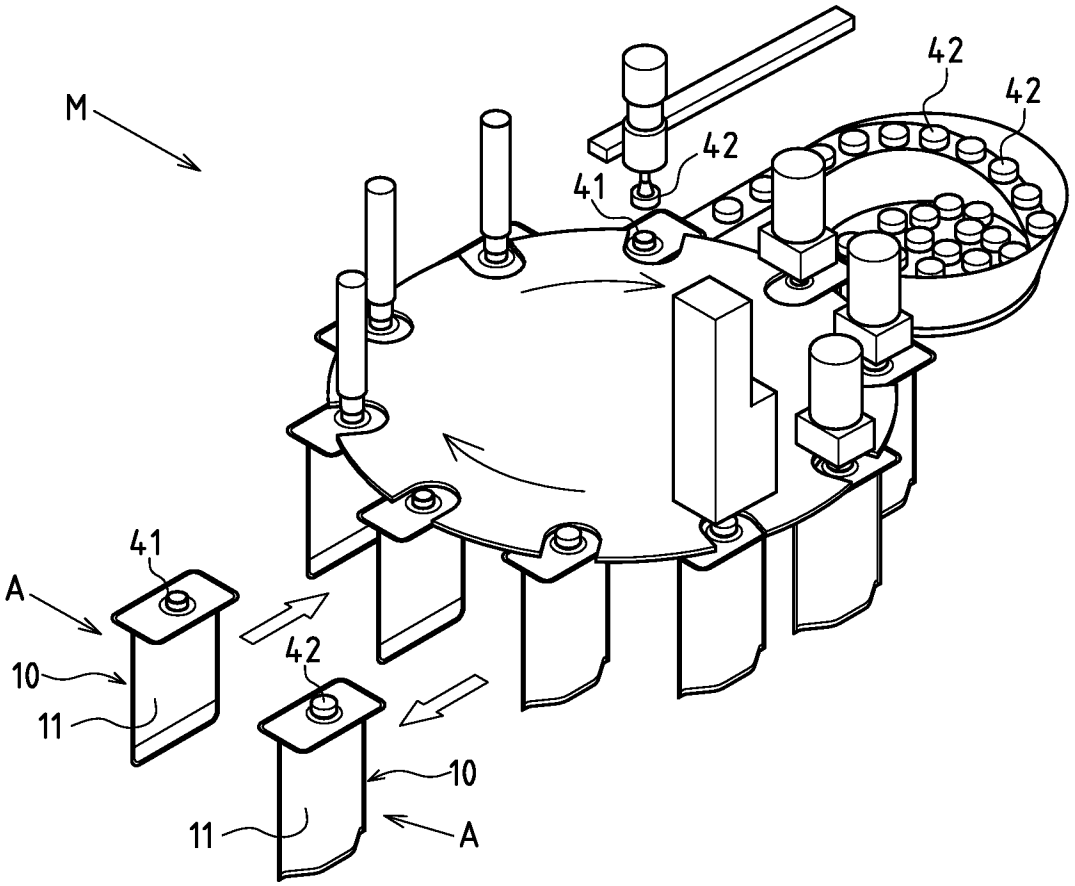
FIG. 14 shows a status view of the fabrication methods of the present invention.

Referring also to FIGS. 4, 12 and 13, the fabrication method of said self-standing bag comprises:

fabricating a main material coil 50 while providing materials required for forming two side walls 11 of the main bag body 10;

fabricating a top wall material coil 51 while providing top wall forming belt 511 required for forming top wall 20 of the main bag body 10;

besides, the fabrication method further comprises: fabricating a bottom wall material coil 52 while providing a bottom wall forming belt 521 required for forming the bottom wall 12 of the main bag body 10;

the main material coil 50 is cut into two side wall forming belts 53 via a cutting means B; then these two side wall forming belts 53 are guided into vertical transfer state via a guiding means C;

a side of the upper side wall forming belt 53 is bent into a folding flange 54 via a bending means D;

the top wall forming belt 511 is guided onto one side of two side wall forming belts 53 with a folding flange 54 via a second guiding means E, so that the nozzle 41 could be more easily incorporated onto the top wall forming belt 511;

a nozzle feeding mechanism 60 is fabricated on the guiding path of the top wall forming belt 511, and punch holes 512 are formed at interval onto the top wall forming belt 511 via a punching means F; then, the nozzle feeding mechanism 60 is used to feed the preset nozzle 41 into the punch hole 512 formed on the top wall forming belt 511; next the nozzle 41 is located into the punch hole 512 via a hot-pressing means G;

the bottom wall forming belt 521 is guided via a third guiding means H to one side between two side wall forming belts 53 far away from the folding flange 54;

after the process of third guiding means H, the bottom wall forming belt 521 is folded into a folding pattern via a folding means I to be abutted against two side wall forming belts 53; of which, a slotting means L is used to form through-holes 522 of preset spacing on the bottom wall forming belt 521 in a folding pattern; and said through-holes 522 are aligned with pressing line 70, so that the corresponding two side wall forming belts 53 can penetrate said through-holes 522 in hot-pressing fusion state;

using a hot-pressing means J, a pressing line 70 is formed at preset spacing between the abutted two side wall forming belts 53, top wall forming belt 511 and bottom wall forming belt 521;

using a tailoring means K, said pressing line 70 is tailored to fabricate said self-standing bag A; referring to FIG. 14, after the self-standing bag A is cut by the tailoring means K, a predefined object 80 (e.g.: beverage or syrup only marked in FIG. 3) is filled from the nozzle 41 through a filling& capping means M, then a cover 42 is covered onto the nozzle 41.

The core aspect of the self-standing bag A of the present invention lies in that, foldable flanges 30, 30B are extended from the top of two side walls 11 of the main bag body 10. As shown in FIGS. 2 and 3, the top of two side walls 11 is separated by the top wall 20, rather than two conventional side walls' tops that are connected in a flat state, so these two side walls 11 of the present invention can be expanded into a tubular space, and then the bottom of these two side walls 11 is supported in a flush state, enabling the self-standing bag to be positioned stably; Furthermore, with the arrangement of the foldable flanges 30, 30B, the print ads space of the self-standing bag A can be increased, allowing for flexible and convenient arrangement of the letters, patterns and trademarks for marketing purpose.

Additionally, based on the design that an opening 31 is formed between two corresponding sides of the foldable flanges 30, 30B, these two foldable flanges 30, 30B are disconnected. After the users purchase the products packaged by the self-standing bag A, these two foldable flanges 30, 30B can be folded into a transversely extension state (see FIG. 10), or folded downwards to be abutted externally against the side wall 11 (see FIG. 11), so the nozzle 41 and cover 42 on the top wall 20 are exposed for ease-of-use. It is thus learnt that these two foldable flanges 30, 30B can improve the convenience for the benefit of the users.

I claim:

1. A method of fabricating a self-standing bag, the method comprising:

fabricating a main material coil while providing materials required for forming two side walls of a main body of the bag;

fabricating a top wall material coil while providing a top wall forming belt required for forming a top wall of the bag;

cutting the mail material coil into two side wall forming belts;

guiding the side wall forming belts into a vertical transfer state;

bending a side of an upper side wall forming belt of the side wall forming belt into a folding flange;

guiding the top wall forming belt onto one side of the side wall forming belt with another folding flange;

fabricating a nozzle feeding mechanism onto a guiding path of the top wall forming belt;

forming punch holes at intervals onto the top wall forming belt;

feeding a preset nozzle of the nozzle feeding mechanism into the punch hole;

locating the preset nozzle into the punch hole via a hot-pressing mechanism;

guiding a bottom wall forming belt to one side between the two side wall forming belts far away from the folding flange;

forming a pressing line at a desired spacing between the side wall forming belts and the top wall forming belt with the hot-pressing mechanism; and tailoring the pressing lines to form the self-standing bag.

2. The method of claim 1, further comprising:

fabricating a bottom wall of the bag with a bottom wall material coil; and forming through-holes at intervals on the bottom wall forming belt in a folding pattern, the through-holes being aligned with the pressing line such that the side wall forming belt can penetrate through the through-holes in a hot-pressing state.

3. The method of claim 1, the step of tailoring comprising cutting the self-standing bag, the method further comprising:

filling a predefined object from the nozzle; and covering the nozzle with a cover.

* * * * *